US006612774B1

(12) United States Patent
Dulin

(10) Patent No.: US 6,612,774 B1
(45) Date of Patent: Sep. 2, 2003

(54) METHOD AND APPARATUS FOR COMPACTING ROAD SHOULDERS

(75) Inventor: Rick Dulin, 2576 Lindsey Rd., Sidney, OH (US) 45365

(73) Assignee: Rick Dulin, Sidney, OH (US)

( * ) Notice: Subject to any disclaimer, the term of this patent is extended or adjusted under 35 U.S.C. 154(b) by 214 days.

(21) Appl. No.: 09/375,712

(22) Filed: Aug. 17, 1999

Related U.S. Application Data

(60) Provisional application No. 60/133,804, filed on May 11, 1999.

(51) Int. Cl.[7] ..... E01C 19/26
(52) U.S. Cl. ..... 404/104; 404/127; 404/128
(58) Field of Search ..... 404/104, 108, 404/127, 128, 133.2, 101; 180/20

(56) References Cited

U.S. PATENT DOCUMENTS

| | | | | | |
|---|---|---|---|---|---|
| 3,072,025 | A | * | 1/1963 | Cronin | 404/127 |
| 3,146,686 | A | * | 9/1964 | Grace et al. | 404/127 |
| 3,291,013 | A | | 12/1966 | Stolp | |
| 3,326,101 | A | * | 6/1967 | Brisbin | 404/122 |
| 3,554,291 | A | * | 1/1971 | Rogers | 172/4.5 |
| 4,193,710 | A | | 3/1980 | Pietrowski | |
| 4,311,408 | A | | 1/1982 | Wren | |
| 4,422,796 | A | | 12/1983 | Tavernier | |
| 4,571,119 | A | * | 2/1986 | Jones et al. | 404/96 |
| 4,579,479 | A | * | 4/1986 | Bryant | 404/103 |
| 4,702,644 | A | | 10/1987 | Cioffi | |
| 4,790,715 | A | | 12/1988 | Alexander | |
| 4,900,185 | A | | 2/1990 | Foertsch | |
| 5,114,269 | A | | 5/1992 | Shepherd | |
| 5,304,013 | A | | 4/1994 | Parsons | |
| 5,395,182 | A | * | 3/1995 | Rossburger | 404/122 |
| 5,507,593 | A | * | 4/1996 | Hollon et al. | 404/122 |
| 6,089,785 | A | * | 7/2000 | Bergman | 404/101 |

* cited by examiner

*Primary Examiner*—Thomas B. Will
*Assistant Examiner*—Raymond Addie

(57) ABSTRACT

A method and apparatus for compacting a road shoulder by a vehicle positioned on a road surface. The apparatus includes a compactor support structure detachably mounted to a front end of the vehicle and including a guide member which slidably receives a horizontally movable ram. A ram linear actuator interconnects the guide member and ram wherein activation of the ram linear actuator causes horizontal movement of the ram. A pair of laterally spaced arms are pivotally mounted to the ram and rotatably support a roller. A pair of arm linear actuators connect the arms to the ram wherein activation of the arm linear actuators causes vertical movement of the roller.

16 Claims, 6 Drawing Sheets

METHOD AND APPARATUS FOR COMPACTING ROAD SHOULDERS

CROSS REFERENCE TO RELATED APPLICATION

This applications claims the benefit of U.S. Provisional Application Ser. No. 60/133,804, filed May 11, 1999.

BACKGROUND OF THE INVENTION

1. Field of the Invention

The present invention relates to a ground compacting method and apparatus and, more particularly, to a method and apparatus for the compacting of a road shoulder.

2. Description of the Prior Art

The shoulders of roads are often supplied with granular material, such as gravel or sand. Immediately after the initial distribution of such gravel or sand, the shoulders are soft and should not be subjected to the full weight of a vehicle. It is preferable to compact the material such that it forms a substantially hard surface which supports a vehicle without the material redistributing and thereby causing ruts or grooves in the shoulder.

The conventional method of preparing road shoulders consists of distributing gravel from the rear of a dump truck and then compacting the gravel with an independently driven rolling device. Unfortunately, such rolling devices are not intended for independent highway travel to and from a job site, such that they must be transported upon a larger vehicle. Additionally, time must be spent unloading and loading the rolling device from and to the larger transport vehicle at the job site.

In order to avoid the disadvantages of transporting a separate rolling device, road crews preparing a shoulder will often utilize the rear tires of the dump truck to compact the road shoulder. Unfortunately, the tires of the dump truck will often cause ruts within the freshly distributed shoulder material. Additionally, given the limited width of conventional truck tires, several passes are often required in order to adequately compact the shoulder material.

While attempts have been made to solve the aforementioned problems in compacting road shoulders, none have provided an apparatus for efficiently and safely preparing the shoulder of a road without requiring independently driven pieces of equipment. For example, U.S. Pat. No. 4,193,710 discloses a roller centrally mounted to the front of a dump truck. The roller may be vertically moved into and out of engagement with a road surface. While such an apparatus may be adequately used for compacting a road surface, it is not intended to efficiently compact a shoulder adjacent the road surface. The shoulders of roads are often positioned immediately adjacent ditches or gullies such that positioning a roller which is centrally mounted to a truck on the shoulder will result in the tires along one side of the truck being positioned on a steep embankment. This leads to instability of the truck, thereby jeopardizing the safety of the road crew members located therein or adjacent thereto. Furthermore, since the wheels of one side of the truck may be positioned on the embankment below the wheels of the other side of the truck, the roller may often be disposed in non-parallel relation to the shoulder resulting in uneven compacting of the shoulder material.

Accordingly, there is a need for a method and apparatus for compacting a ground surface including a vehicle which does not need to leave the road surface while compacting the shoulder of the road. Further, there is a need for such an apparatus which includes an applicator for spreading granular material, preferably gravel, on the ground which is then compacted.

SUMMARY OF THE INVENTION

The present invention provides a method and apparatus for compacting a road shoulder by a vehicle traveling along a road without requiring the vehicle to leave the road surface and contact the shoulder.

The apparatus of the present invention includes a compactor support structure having at least one mounting bracket detachably mounted to the front end of a vehicle. The compactor support structure supports a compactor having an engagement surface for compacting the shoulder. The compactor is adapted for both vertical and horizontal movement relative to the vehicle such that it may be moved from a rest position adjacent the longitudinal center axis of the vehicle and above the road to an operative position positioned outwardly from the longitudinal center axis and in engaging contact with the shoulder.

The at least one mounting bracket of the compactor support structure is removably supported by a conventional accessory mount of the truck. The compactor support structure includes a guide member which slidably receives a horizontally movable ram. A first, or ram, linear actuator interconnects the guide member to the ram wherein activation of the ram linear actuator causes horizontal movement of the ram. The first ends of a pair of laterally spaced arms are pivotally supported by the ram. Second ends of the pair of arms support the compactor, preferably a rotatably mounted roller. A pair of second, or arm, linear actuators connect the second ends of the arms to the ram wherein activation of the arm linear actuators causes pivoting movement of the arms. As the arms pivot, the roller is moved in substantially vertical movement.

A control unit controls the operation of the ram and arm actuators and is supported by the guide member. A pendant controller communicates with the control unit wherein an operator in the cab of the vehicle may manipulate the pendant controller thereby causing activation of the actuators and corresponding movement of the roller.

The apparatus of the present invention also preferably includes a material applicator connected to the rear end of the vehicle in spaced relation to the roller. The material applicator includes a spreader for distributing granular material, preferably gravel, which is later compacted by the roller. As such, a single apparatus may be used to efficiently apply and compact material along a road shoulder.

The method of the present invention includes distributing a granular shoulder material, preferably gravel, along the shoulder of a road from an applicator supported by a vehicle positioned on the road surface. Next, an actuator is activated for moving a ram supporting a roller horizontally outwardly from a longitudinal center axis of the vehicle positioned on the road surface. The roller supported by the ram is then pivoted downwardly into engagement with the freshly distributed gravel. The vehicle next simultaneously moves in a direction from the roller to the applicator in substantial alignment with the shoulder wherein the freshly distributed gravel is compacted by the roller.

Therefore, it is an object of the present invention to provide a method and apparatus for distributing and compacting ground surfaces.

It is a further object of the present invention to provide such an apparatus which is self-transportable.

It is another object of the present invention to provide such a self-transportable apparatus having a compactor which may be retracted from an operative position to a rest position thereby permitting the vehicle to travel at ordinary speeds along a road to and from the job site.

It is yet another object of the present invention to provide an apparatus for compacting road shoulders while traveling along a road but not along the shoulder.

It is a further object of the present invention to provide such an apparatus which is flexible in attaching to conventional accessory brackets on the front of vehicles.

It is still yet another object of the present invention to provide a single apparatus for the distribution and compacting of road shoulder materials.

Other objects and advantages of the invention will be apparent from the following description, the accompanying drawings and the appended claims.

DETAILED DESCRIPTION OF THE PREFERRED EMBODIMENT

Figure 1:
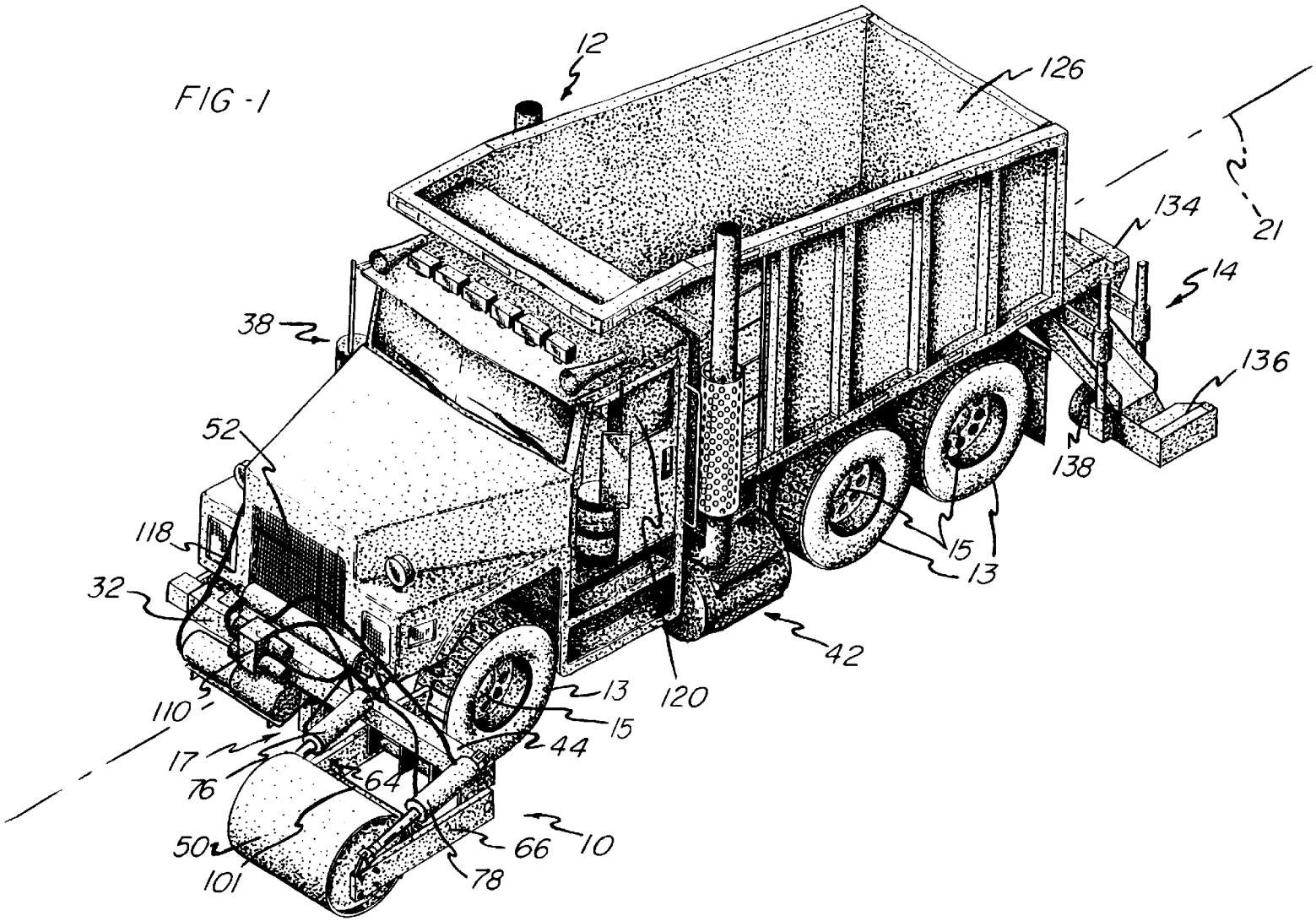
FIG. 1 is a perspective view of a truck provided with the compacting apparatus of the present invention in combination with a material distributor, the compacting apparatus shown in a rest position.
Figure 2:
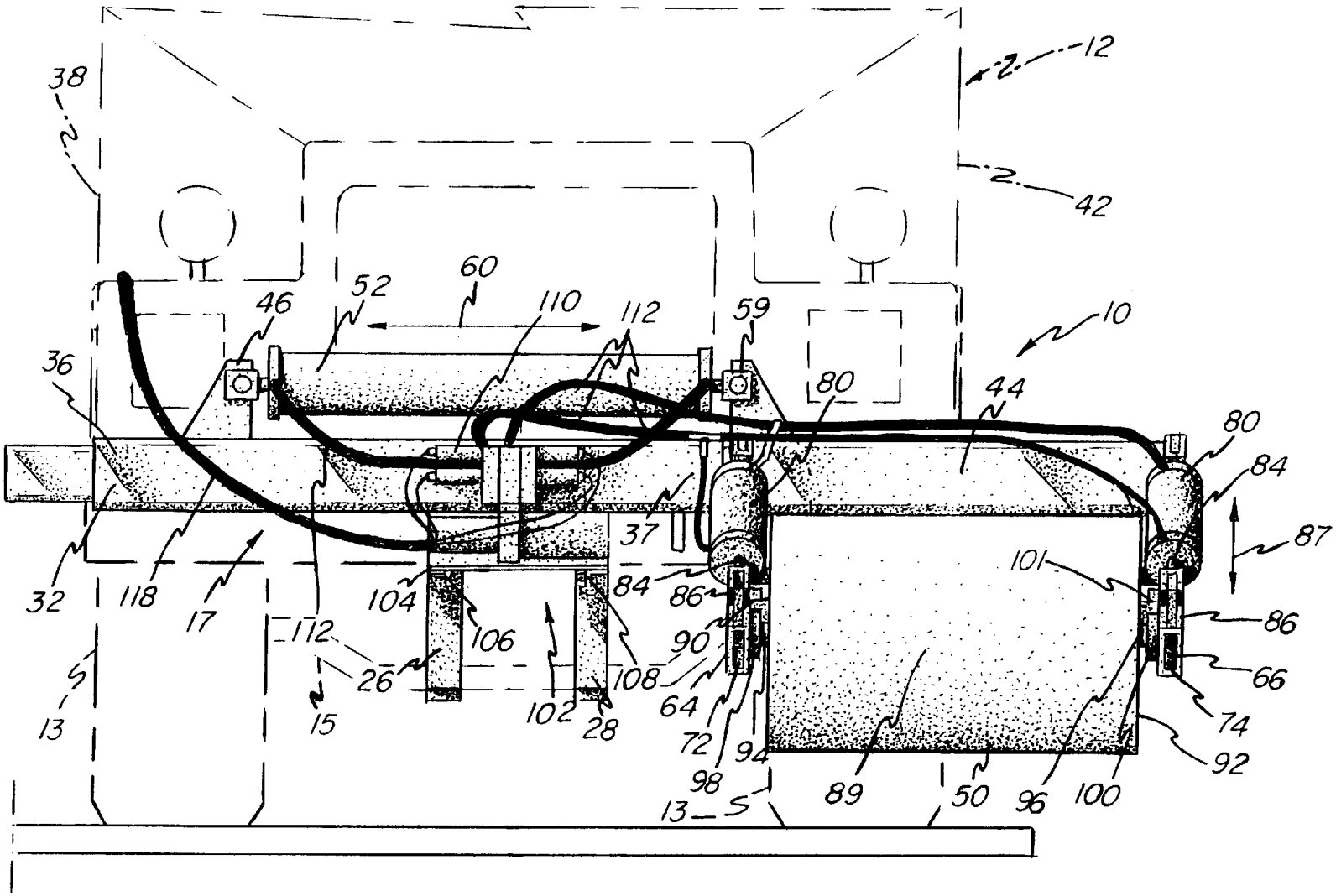
FIG. 2 is a front elevational view of the compacting apparatus of FIG. 1.

Referring initially to FIGS. 1 and 2, the road shoulder compacting apparatus 10 of the present invention is illustrated in combination with a truck 12 and a material applicator 14. The truck 12 is supported by a plurality of wheels 13 rotatably mounted to a plurality of axles 15. However, any suitable vehicle may be utilized with the compacting apparatus 10 of the present invention. For ease of attaching and removing the compacting apparatus 10, it is desirable that the vehicle comprise a snow removal type truck 12 having a traditional accessory mount 16 (FIG. 4) which is fixed to the front of the of truck 12 in a conventional manner. The accessory mount 16 preferably consists of the type used to support snow plows, such as Bumper Angle Assembly, Part No. 5421-A1, which is available from Gledhill Road Machinery Co., of Galion, Ohio. However, it should be appreciated that similar accessory mounts may be substituted therefor.

Figure 3:
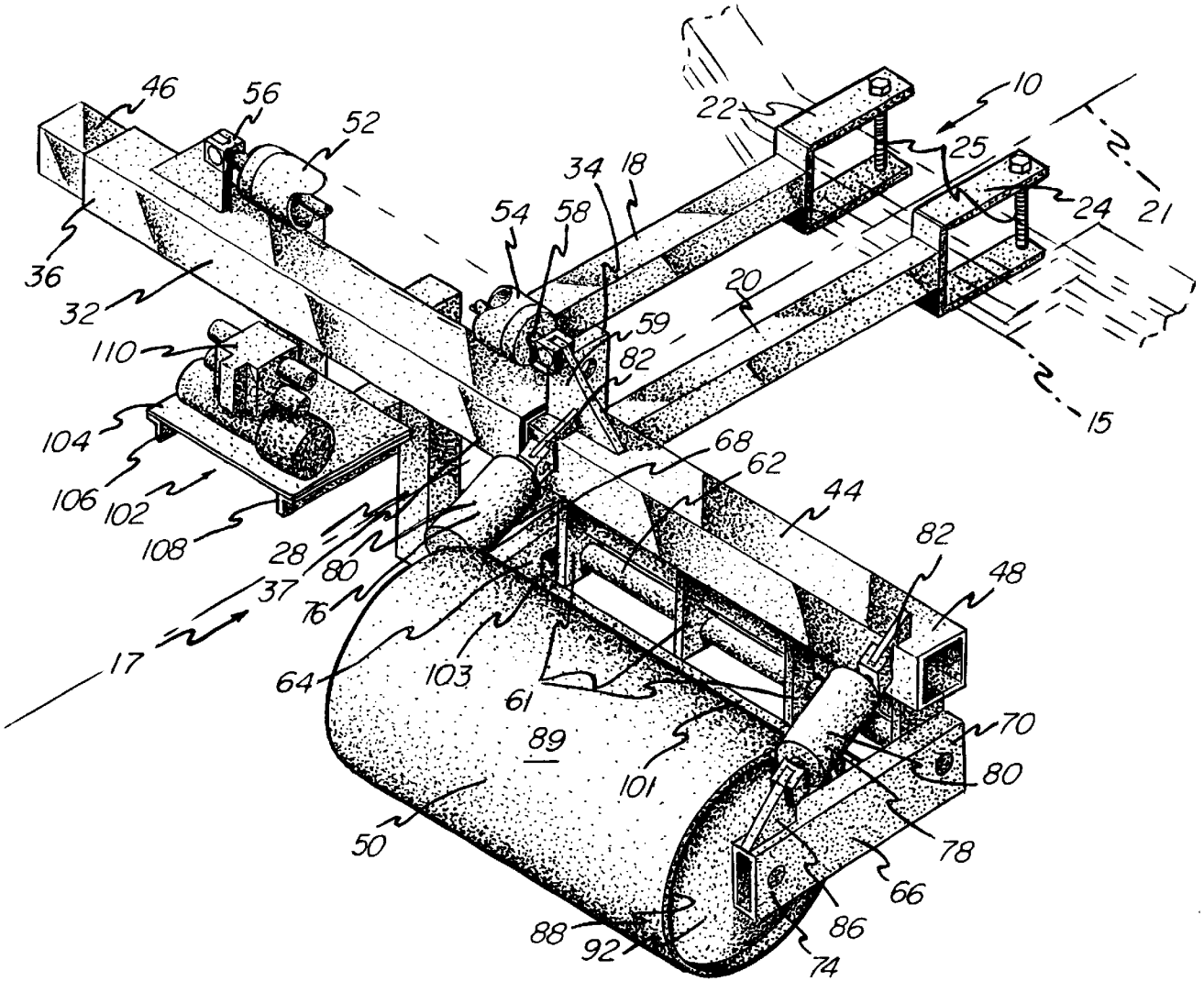
FIG. 3 is a front perspective view of the compacting apparatus of FIG. 1.

As illustrated in FIGS. 2 and 3, the compacting apparatus 10 of the present invention includes a compactor support structure 17 including a pair of laterally spaced horizontal arms 18 and 20 extending in substantially parallel relation to the longitudinal axis 21 of the truck 12 (FIG. 3). A pair of axle mounts 22 and 24 are positioned at a first end of the horizontal arms 18 and 20 for receiving an axle 15 of the truck 12 (FIG. 3). Bolts 25 pass through each bracket 22 and 24 to assist in retaining the axle with the brackets 22 and 24. A pair of uprights 26 and 28 extend upwardly from the second ends of the horizontal arms 18 and 20.

Referring further to FIGS. 2–3, the compacting apparatus 10 of the present invention includes a guide member 32 fixed to the uprights 26 and 28 by conventional fastening means, such as welding. A pair of mounting brackets 33 and 34 are fixed to the guide member 32 outside of the uprights 26 and 28 for releasably attaching to the accessory mount 16 of the truck 12, typically by way of pins 35 passing through coaxially aligned apertures of the accessory mount 16 and the brackets 33 and 34. The guide member 32 includes first and second ends 36 and 37 wherein the first end 36 is positioned proximate a first side 38 of the truck 12 while the second end 37 of the guide member 32 is positioned proximate the center axis 21 of the truck 12 intermediate the first side 38 and a second side 42 (FIG. 1).

Figure 4:
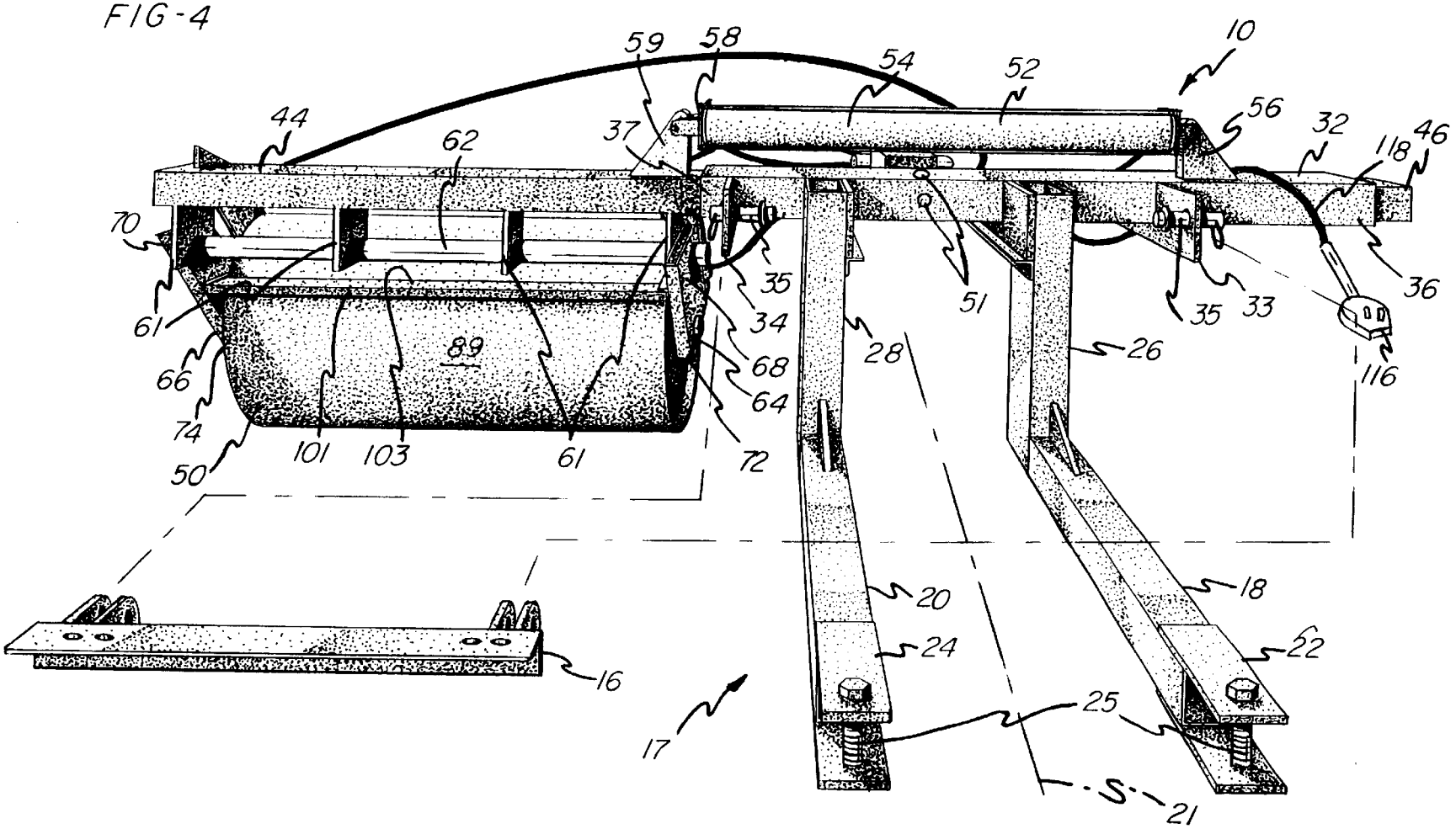
FIG. 4 is a rear perspective view of the compacting apparatus of FIG. 1.

A ram 44 having opposing first and second ends 46 and 48 is slidably received within the guide member 32. A compactor, preferably a rotatable roller 50, is disposed proximate the second end 48 of the ram 44. In the rest position as illustrated in FIGS. 1–4, a first end 46 of the ram 44 extends outwardly from the first end 36 of the guide member 32. Both the guide member 32 and ram 44 preferably comprise tubular steel. Ports 51 may be provided within the guide member 32 to assist in the application of lubricating compounds between the ram 44 and guide member 32 (FIG. 4).

A ram linear actuator 52 operably connects the guide member 32 to the ram 44. More particularly, the ram linear actuator 52 comprises a hydraulic cylinder having a body 54 connected to a bracket 56 which is preferably welded to an upper surface of the guide member 32. The rod 58 of the hydraulic cylinder 52 is preferably connected to a bracket 59 which is welded to an upper surface of the ram 44. As may be appreciated, activation of the hydraulic cylinder 52 causes substantially horizontal movement of the rod 58 and the connected ram 44 in the direction of arrow 60 (FIG. 2). While the hydraulic cylinder 52 preferably comprises Part No. 022935-324 available from Cross Manufacturer of Lewis, Kans., any similar linear actuator may be readily substituted therefor.

A plurality of support plates 61 extend downwardly from a lower surface of the ram 44 and include coaxially aligned apertures for receiving a rotatably mounted pivot rod 62. First and second arms 64 and 66 have first ends 68 and 70 fixed to opposing ends of the pivot rod 62. Second ends 72 and 74 of the first and second arms 64 and 66 rotatably support the roller 50. The first and second arms 64 and 66 are preferably formed of tubular steel.

First and second arm linear actuators 76 and 78 operably connect the first and second arms 64 and 66 to the ram 44. More particularly, the arm linear actuators 76 and 78 preferably comprise hydraulic cylinders, each cylinder having a body portion 80 connected to a bracket 82 which is preferably welded to the ram 44. The rod 84 of each cylinder 76 and 78 is attached to a bracket 86 which is welded to an upper surface of one of the first and second arms 64 and 66. It may be appreciated that activation of the cylinders 76 and 78 in order to extend and retract their respective rods 84 causes pivoting movement of the arms 64 and 66 resulting in substantially vertical movement of the roller 50 in the direction of arrow 87 (FIG. 2). While the hydraulic cylinders 76 and 78 preferably comprise Part No. 027560-408 available from Cross Manufacturer of Lewis, Kans., any similar linear actuator may be readily substituted therefor.

The roller 50 preferably comprises a hollow steel drum 88 having an outer engagement surface 89. A pair of opposing discs 90 and 92 are welded to the ends of the drum 88. First and second shafts 94 and 96 extend outwardly from the discs 90 and 92 and are rotatably received within bearings 98 and 100. The bearings 98 and 100, in turn, are fixed to the second ends 72 and 74 of the first and second arms 64 and 66 (FIG. 2).

Referring further to FIGS. 3 and 4, a scraper blade 101 extends between the first and second arms 64 and 66 and cooperates with the roller 50 to remove debris from the outer engagement surface 89 as the roller 50 rotates. More particularly, the scraper blade 101 includes an edge 103 in close proximity to the engagement surface 89 and extending between opposing discs 90 and 92.

The ram hydraulic cylinder 52 and first and second arm hydraulic cylinders 76 and 78 are controlled by a control unit 102 mounted on a platform 104. The platform 104 is supported by a pair of L-channel arms 106 and 108 fixed to the guide member 32. The control unit 102 preferably includes a distributor unit 110 having a solenoid valve (not shown) for distributing hydraulic fluid to the various hydraulic cylinders 52, 76 and 78 by way of fluid lines 112. The distributor unit 110 preferably comprises Part No. 1787-AC 12VDC available from Fenner Fluid Power of Rockford, Ill. However, it should be appreciated that any similar distributor unit may be readily substituted therefor.

A pendant controller 116 is in communication with the distributor unit 110 through a control cable 118. The pendant controller 116 is preferably positioned within the cab 120 of the truck 12 for convenient operation by the driver.

Referring now to FIG. 4, the pendant controller 116 includes horizontal and vertical toggle switches 122 and 124 for controlling activation of the ram cylinder 52 and first and second arm cylinders 76 and 78, respectively. More particularly, horizontal movement of the toggle switch 122 results in the extension or retraction of the ram cylinder 52 and connected ram 44. As such, the roller 50 is moved outwardly away from the center axis 21 of the truck 12. Likewise, vertical movement of the toggle switch 124 results in the extension or retraction of the arm cylinders 76 and 78 resulting in pivoting movement of the arms 64 and 66 and substantially vertical movement of the roller 50.

Referring further to FIGS. 1 and 4, the material applicator 14 is positioned near the rear of the truck 12 and is in communication with the bed 126 thereof. As such, granular shoulder material 128, preferably gravel or sand, may be released from the bed 126 and directed to the shoulder 130 of the road 132 by the applicator 14. The applicator 14 includes a conveyor box 134 in communication with the bed 126 of the truck 12 and a spreader 136 in communication with the conveyor box 134 and guided by a support wheel 138. The conveyor box 134 and spreader 136 may be raised for highway travel of the truck 12 in a manner well known in the art.

The conveyor box 134 is of conventional design and may comprise Model 1800, available from H.T.C. Inc. of Milford, Iowa. Additional details of the conveyor box 134 are disclosed in U.S. Pat. No. 4,790,715 which is incorporated herein by reference. The spreader 136 is likewise of conventional design and may comprise a Moon Paver available from Moon Paver, Inc. of Butler, Pa. Additional details of the spreader 136 are disclosed in U.S. Pat. No. 4,900,185 which is incorporated herein by reference.

Figure 5:
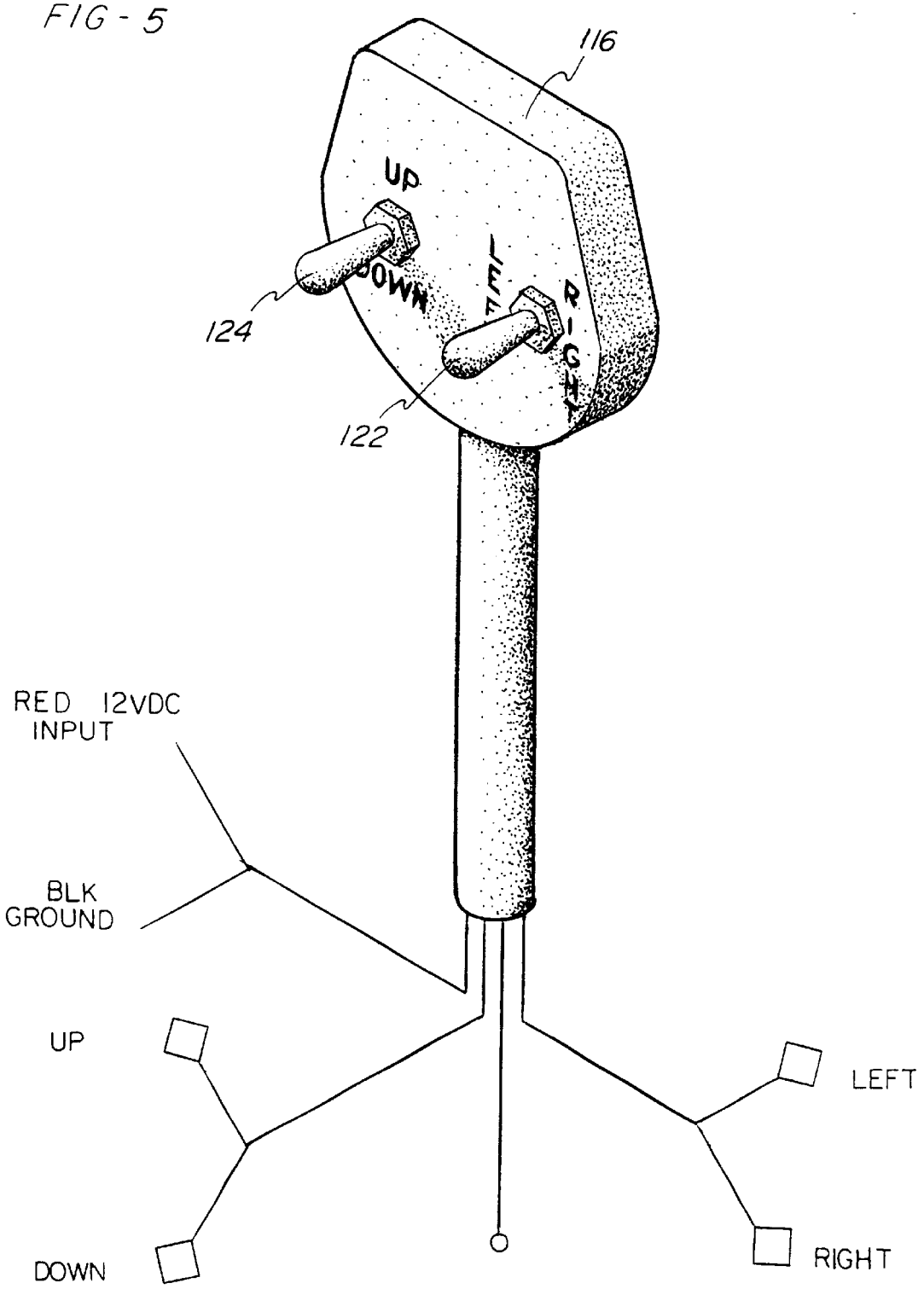
FIG. 5 is a perspective view of the pendant controller of the present invention with the accompanying control connections shown in schematic.
Figure 6:
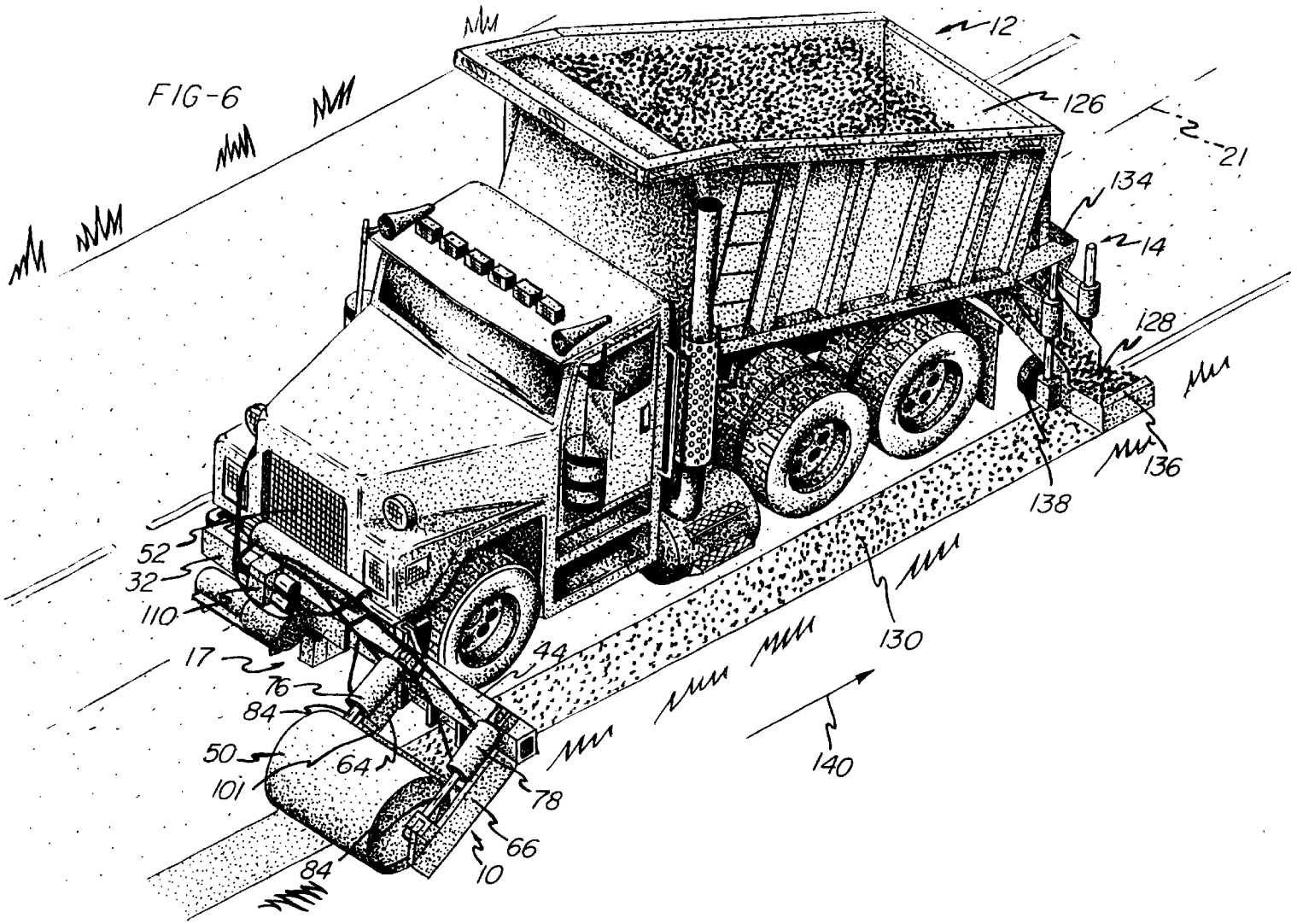
FIG. 6 is a perspective view of a truck provided with the compacting apparatus of FIG. 1 in combination with a material distributor, the compacting apparatus shown in an operative position.

The operation of the road shoulder compacting apparatus 10 in combination with the truck 12 and material applicator 14 will now be discussed in greater detail. FIGS. 1 and 2 illustrate the compacting apparatus 10 in a rest position wherein the truck 12 may be driven normally along the road 132 (FIG. 5). In a rest position, the roller 50 is raised above the road 132 such that the first and second arms 64 and 66 are substantially horizontal. Also in the rest position, the ram 44 is retracted to a position where the roller 50 is proximate the center axis 21 of the truck 12. Only a portion, if any, of the ram 44 extends beyond the second side 42 of the truck 12 such that the roller 50 does not interfere with normal road driving of the truck 12.

FIG. 5 illustrates the method of preparing a road shoulder in accordance with the present invention. Initially a granular shoulder material 128, preferably gravel, is discharged from the bed 126 of the dump truck 12 through the material applicator 14 where the spreader 136 applies the material 128 to the shoulder 130 of the road 132. The truck 12 is driven in reverse as indicated by direction arrow 140. This results in a layer of shoulder material 128 being applied in a direction parallel to the longitudinal axis 21 of the truck 12. As the front of the truck 12 approaches the newly distributed material 128, the driver moves the horizontal switch 122 of the pendant controller 116 to the right position. The pendant controller 116 instructs the distributor unit 110 to operate a solenoid valve (not shown) thereby causing the rod 58 of the ram hydraulic cylinder 52 to extend and the ram 44 to move outwardly away from the longitudinal axis 21 of the truck 12.

When the roller 50 is properly aligned over the freshly distributed shoulder material 128, the driver then moves the vertical switch 124 of the pendant controller 116 to the down position thereby instructing the distributor unit 110 to operate a solenoid valve for directing hydraulic fluid to extend the rods 84 of the first and second arm hydraulic cylinders 76 and 78. As the rods 84 of the cylinders 76 and 78 extend, the first and second arms 64 and 66 pivot downwardly thereby causing the engagement surface 89 of the roller 50 to contact the freshly distributed shoulder material 128. As the truck 12 is moved in the direction of arrow 140, the shoulder material 128 is compacted by the rotating engagement surface 89 of the roller 50. As such, the soft shoulder material 128 is transformed into a hard surface 142 which may support a vehicle.

When preparation of the road shoulder 130 has been completed, the conveyor box 134 and spreader 136 of the applicator 14 are raised. The driver then moves the vertical switch 124 of the pendant controller 116 to the up position thereby instructing the distributor unit 110 to direct hydraulic fluid to retract the rods 84 of the first and second arm hydraulic cylinders 76 and 78. As the rods 84 retract, the first and second arms 64 and 66 pivot upwardly thereby raising the roller 50 in substantially vertical movement. Next, the driver moves the horizontal switch 122 of the pendant controller 116 to the left position. The pendant controller 116 communicates with the distributor unit 110 which then operates a solenoid valve causing the rod 58 of the ram hydraulic cylinder 52 to retract. In response, the ram 44 and roller 50 move inwardly towards their rest position proximate the center axis 21 of the truck 12. The truck 12 is then in a condition for conventional road driving.

While the method herein described, and the form of apparatus for carrying this method into effect, constitute preferred embodiments of this invention, it is to be understood that the invention is not limited to this precise method and form of apparatus, and that changes may be made in either without departing from the scope of the invention which is defined in the appended claims.

What is claimed is:

1. A shoulder compacting apparatus for use in combination with a vehicle defining a longitudinal axis and positioned on a road adjacent the shoulder, the vehicle including front and rear ends and a plurality of axles supporting a plurality of wheels, said shoulder compacting apparatus comprising:

at least one mounting bracket adapted for detachably mounting to the front end of the vehicle;

a guide member supported by said at least one mounting bracket;

a first linear actuator supported by said guide member;

a ram engaging said guide member and operably connected to said first linear actuator, said ram actuated by said first linear actuator in substantially horizontal linear movement in a direction substantially perpendicular to the longitudinal axis of the vehicle;

at least one arm supported for movement relative to said ram;

a roller rotatably supported by said at least one arm;

a second linear actuator operably connecting said ram and said at least one arm, said roller actuated by said second linear actuator in substantially vertical movement; and wherein said roller is moveable from a rest position horizontally adjacent the longitudinal axis of the vehicle and vertically above the road surface to an operative position horizontally spaced laterally outwardly from said rest position and vertically below said rest position such that said roller is in engagement with the shoulder.

2. The shoulder compacting apparatus of claim 1 wherein said at least one arm comprises a pair of laterally spaced arms having first ends pivotally mounted to said ram and second ends rotatably supporting opposing ends of said roller.

3. The shoulder compacting apparatus of claim 1 wherein said guide member slidably receives said ram.

4. The shoulder compacting apparatus of claim 1 further comprising a support structure including an upright extending vertically down from said guide member and an axle connector extending horizontally toward the rear end of the vehicle and mounted to one of the axles.

5. The shoulder compacting apparatus of claim 1 further comprising a scraper blade supported by said at least one arm and having a cleaning edge cooperating with said roller for removing material from an outer surface of said roller.

6. The shoulder compacting apparatus of claim 1 further comprising a material applicator supported at the rear end of the vehicle, said material applicator including a conveyor box and a spreader in communication with said conveyor box.

7. The shoulder compacting apparatus of claim 1 further comprising a control unit operably connected to said first and second linear actuators, said control unit supported by said guide member.

8. The shoulder compacting apparatus of claim 7 further comprising a pendant controller in communication with said control unit for controlling independent horizontal and vertical movement of said roller by an operator.

9. An apparatus for preparing a shoulder positioned adjacent a road surface, said apparatus comprising:

a vehicle defining a longitudinal axis and including opposing front and rear ends, a plurality of axles, a plurality of wheels supported by said plurality of axles, and a bed positioned adjacent said rear end for storing a granular material;

a material applicator supported adjacent said rear end of said vehicle and including a spreader in communication with said bed for spreading the granular material on the shoulder;

a compacting apparatus supported adjacent said front end of said vehicle and including a guide member, a ram engaging said guide member, a ram linear actuator supported by said guide member and operably connected to said ram, a pair of laterally spaced arms supported for movement relative to said ram, a roller rotatably supported intermediate said pair of arms, at least one arm linear actuator operably connecting said ram and at least one of said pair of arms; and wherein said roller is moveable from a rest position laterally adjacent said longitudinal axis of said vehicle and vertically above the road surface to an operative position spaced laterally outwardly from and vertically below said rest position and in engagement with the shoulder.

10. The apparatus of claim 9 wherein said pair of laterally spaced arms include first ends pivotally mounted to said ram and second ends rotatably supporting opposing ends of said roller.

11. The apparatus of claim 9 wherein said guide member slidably receives said ram.

12. The apparatus of claim 11 further comprising a support structure including an upright extending vertically downwardly from said guide member, and an axle connector extending horizontally substantially perpendicular to said longitudinal axis toward said rear end of said vehicle and mounted to one of said axles.

13. The apparatus of claim 9 further comprising a scraper blade supported intermediate said pair of arms and having a cleaning edge for cooperating with said roller for removing material from an outer surface of said roller.

14. The apparatus of claim 9 further comprising a control unit in communication with said ram linear actuator and said at least one arm linear actuator, said control unit supported by said guide member.

15. The apparatus of claim 14 further comprising a pendant controller in communication with said control unit for controlling independent horizontal and vertical movement of said roller.

16. A method of preparing road shoulders comprising the steps of:

positioning a vehicle on a road surface, said vehicle defining a longitudinal axis extending between opposing front and rear ends;

providing a roller and a ram supported by said front end of said vehicle, said roller further positioned proximate said longitudinal axis of said vehicle above said road surface;

providing a guide member operably connected to said ram;

providing a ram linear actuator operably connecting said ram and said guide member;

actuating said ram linear actuator for moving said roller linearly outwardly from said longitudinal axis in a substantially horizontal plane;

stopping movement of said roller when said roller is positioned above said shoulder;

providing at least one pivotally mounted arm rotatably supporting said roller;

providing an arm linear actuator operably connected to said at least one arm;

actuating said arm linear actuator for pivotally moving said arm and thereby vertically moving said roller;

moving said vehicle in a direction in substantial alignment with said shoulder; and rotatingly engaging said shoulder with said roller as said vehicle moves.

* * * * *